US005223809A

United States Patent [19]

Myer

[11] Patent Number: 5,223,809

[45] Date of Patent: Jun. 29, 1993

[54] SIGNAL ISOLATING MICROWAVE SPLITTERS/COMBINERS

[75] Inventor: Robert E. Myer, Denville, N.J.

[73] Assignee: AT&T Bell Laboratories, Murray Hill, N.J.

[21] Appl. No.: 873,306

[22] Filed: Apr. 24, 1992

[51] Int. Cl.[5] ..... H01P 5/12

[52] U.S. Cl. ..... 333/127g33; 333/136

[58] Field of Search ..... 333/123, 127, 136

[56] References Cited

U.S. PATENT DOCUMENTS

| | | | |
|---|---|---|---|
| 3,529,265 | 9/1970 | Podell | 333/127 |
| 4,032,849 | 6/1977 | Gysel et al. . | |
| 4,175,257 | 11/1979 | Smith et al. | 330/287 |
| 4,234,854 | 11/1980 | Schellenberg et al. | 330/286 |
| 4,263,568 | 4/1981 | Nemit | 333/127 |
| 4,323,863 | 4/1982 | Weber | 333/109 |
| 4,375,622 | 3/1983 | Hollingsworth et al. | 333/127 X |
| 4,394,629 | 7/1983 | Kumar et al. | 333/109 |
| 4,700,145 | 10/1987 | Yelland et al. | 330/286 |
| 4,812,782 | 3/1989 | Ajioka | 330/286 |
| 4,825,175 | 4/1989 | Tsuda et al. | 330/286 |

OTHER PUBLICATIONS

"A New N-Way Power Divider/Combiner Suitable for High-Power Applications" by U. H. Gysel, *MIT Symposium* Digest, 1975, pp. 116-118.

"An N-Way Hybrid Power Divider" by E. J. Wilkinson, *IRE Transaction on Microwave Theory and Techniques*, 1960, pp. 116-118.

"A Note on N-Way Hybrid Power Dividers" by J. J. Taub and B. Fritzgerald, *IEEE Transactions of Microwave theory and Techniques* pp. 260-261, Mar. 1964.

"N-Terminal Power Divider" by R. W. Peterson, *IRE Transaction on Microwave Theory and Techniques*, p. 571, Nov. 1961.

*Primary Examiner*—Paul Gensler

*Attorney, Agent, or Firm*—Ruloff F. Kip

[57] ABSTRACT

A microwave signal splitter/combiner device includes a primary coaxial connector mounted by a first hub and serving as an input/output for a composite signal to or from the device, secondary coaxial connectors radially spaced in a circle around the primary connector and serving as outputs/inputs for individual signals from and to the device, and rigid "first" coaxial line sections positionally fixed through such hub with the primary connector and extending from it to, respectively, the secondary connectors to hold them positionally fixed. To minimize, the useful signal at any secondary connector from appearing as an extraneous signal at the others, the secondary connectors at their junctions with the first coaxial line sections are respectively electrically coupled to the radially outer ends of "second" "L" shaped rigid coaxial line sections axially away from and extending radially inward from those junctions to terminate in inner ends spaced adjacent each other around a circle and electrically coupled to a common floating point. The second coaxial sections are held fixed at their outer ends relative to the first sections and fixed at their inner ends by a second hub axially spaced from the first hub.

12 Claims, 4 Drawing Sheets

SIGNAL ISOLATING MICROWAVE SPLITTERS/COMBINERS

TECHNICAL FIELD

This invention relates generally to assemblages for handling microwave signals, and which may be splitters or combiners of such signals. More particularly, this invention relates to assemblages of such kind which comprise a primary signal transfer port, a plurality of secondary signal transfer ports, and a plurality of principal signal transfer paths each extending between a corresponding one of said secondary ports and said primary port. When the assemblage is a combiner, individual signals are received at the secondary ports and flow therefrom through such paths to the primary port to there combine to form an output signal from such port. When the device is a splitter, an input signal to the primary port is distributed through such paths to such secondary ports to be split among them so as the convert the input signal into separate output signals. Usually the signal which is an input to or an output from the primary port is a composite signal which consists of a combination of individual microwave signals in different bandwidth channels and which composite signal has a midfrequency and a nominal bandwidth centered on such midfrequency.

BACKGROUND OF THE INVENTION

Assume that the assemblage described above is a combiner having six input ports receiving corresponding signals which are transferred from such ports to the common port to provide therefrom an output combining such originally separate signals. In the case of, say, the signal which is received by the #1 input port and conducted in a path #1 from such port towards the output port, a fraction of that signal will, on its reaching the end of the #1 path, be diverted through the output port to become a desired component of the composite output signal. Since, however, at such end of that #1 path, the other five input ports are electrically coupled in parallel with the output port, other fractions of the #1 signal will, unless something is done, reach such other input ports to there be manifested as extraneous signals. The presence of such extraneous signals at such ports is undesirable because they may flow reversely through such ports, and because of other detrimental electrical effects likely to be produced.

It has been proposed in an article "A New N-Way Power Divider/Combiner Suitable for High Power Applications" authored by Ulrich H. Gysel and published in the MIT Symposium Digest, 1975, pages 116–118 that such problem may be overcome as follows. As disclosed in that article, a microwave circuit (which will be assumed to be a combiner circuit) comprises circuit boards and, also, transmission lines which are all in the form of striplines printed on such boards except that one of such lines is a coaxial line. In such circuit, a primary port is connected by a coaxial line $Z_1$ to a junction to which are also connected a plurality of striplines $Z_2$ connected at their ends away from such junction to corresponding secondary ports. The lines $Z_2$ provide principal paths for transfer of microwave signals between the secondary ports and the mentioned junction.

In order for a signal received at any one secondary port to reach through principal paths any other secondary port as an extraneous signal, that signal must travel through two principal paths a distance between those two ports which is a half wavelength of the microwave signal at the midfrequency of the combiner. The results is that such extraneous signal undergoes a 180° phase shift in the course of such travel.

To reduce the presence of the extraneous signals at the secondary ports, these ports are respectively connected to a plurality of supplemental signal transfer paths each consisting of a stripline $Z_3$ and a stripline $Z_4$ in series, and all connected to a common floating point at their ends away from the secondary ports. Each of such supplemental paths has a length of one half wavelength. Because of the existence of these supplemental paths, the signal received at any one secondary port can reach any other secondary port as an extraneous signal not only through two principal paths as described above but also through two supplemental paths. However, the fraction of that signal which travels through the two supplemental paths to the destination port undergoes in the course of such travel a phase shaft of 360° so as to be exactly out of phase with the fraction of extraneous signal reaching that port through the two principal paths. Hence, if the extraneous signal fractions reaching that destination port through, respectively, the two principal paths and the two supplemental paths are of about the same amplitude (as can be realized), these two signal fractions will almost wholly cancel each other out so as to reduce to low level the resultant extraneous signal at that port.

The circuit disclosed by the Gysel article has, however, the disadvantages that, because of the several odd impedance transmission lines required, stripline or microstrip construction is indicated. However, for high power combining of larger numbers of signals with minimum loss, stripline does not work well, and the circuit is undesirably limited as to the microwave power it can handle as a result of the lower power carrying capacity of the striplines.

SUMMARY OF THE INVENTION

One or more of the disadvantage just mentioned are obviated according to an aspect of the invention by providing a microwave assemblage comprising a primary coaxial signal-transfer connector, a plurality of first rigid equal-length coaxial line sections extending from inner ends thereof adjacent to and electrically coupled to said connector to outer ends of such sections, means mechanically coupling said first sections at their inner ends in positionally fixed relation with each other and said connector, a plurality of secondary coaxial signal-transfer connectors respectively corresponding to said first sections and disposed at their outer ends in electrically coupled relation therewith, said secondary connectors being fixedly mechanically coupled with said rigid first sections to be positionally fixed relative to each other and said first sections, a plurality of second equal-length coaxial line sections respectively corresponding to said first sections and having respective outer and inner ends of which the outer ends are mechanically and electrically coupled with said first sections at their outer ends, and of which the inner ends of said second sections are adjacent to each other and electrically and mechanically coupled together, said second sections being of different lengths than said first sections, and a plurality of external load coaxial connectors respectively corresponding to said second sections and each electrically and mechanically coupled to its corresponding second section centrally in its length between the inner and outer ends thereof. The rigidity of such first coaxial line sections, the mechanical coupling of such first sections at their inner ends in positionally fixed in relation with each other, and the fixed mechanical coupling to such rigid coaxial line sections of the mentioned secondary coaxial line connectors are factors which together cooperate to the end of overcoming one or more of such disadvantages discussed above.

BRIEF DESCRIPTION OF THE DRAWING

For a better understanding of the invention, reference is made to the following description of a representative embodiment thereof, and to the accompanying drawings wherein.

Figure 1:
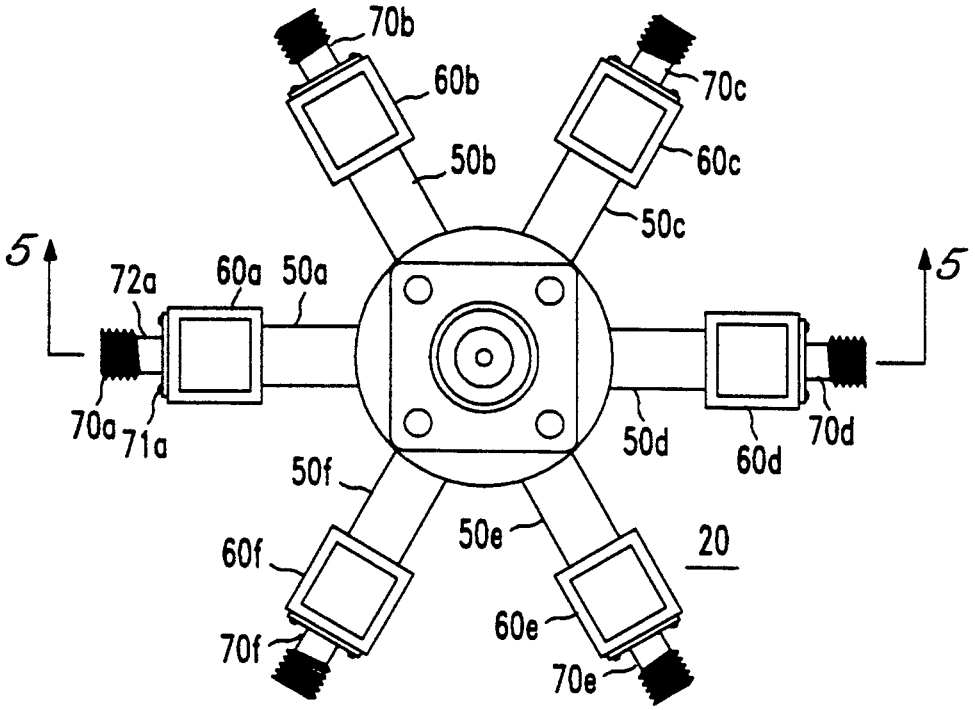
FIG. 1 is a plan view of an exemplary embodiment of the invention in the form of a six-way combiner.

In the description which follows, elements which are counterparts of each other are designated by the same reference numeral while being distinguished by different alphabetical suffixes appended to that numeral, and it is to be understood that a description of any one such element shall, unless the context otherwise indicates, be taken as being equally applicable to all its counterparts.

DETAILED DESCRIPTION OF EMBODIMENT

Referring now to the figures, the reference numeral 20 designates a microwave assemblage of which the structure is functionally suitable for use as either a six-way splitter or six-way combiner, but which will initially herein be considered to be a combiner.

The combiner 20 has a vertical axis 21, and upper and lower axially spaced hubs 22 and 23 coaxial with axis 21.

Figure 2:
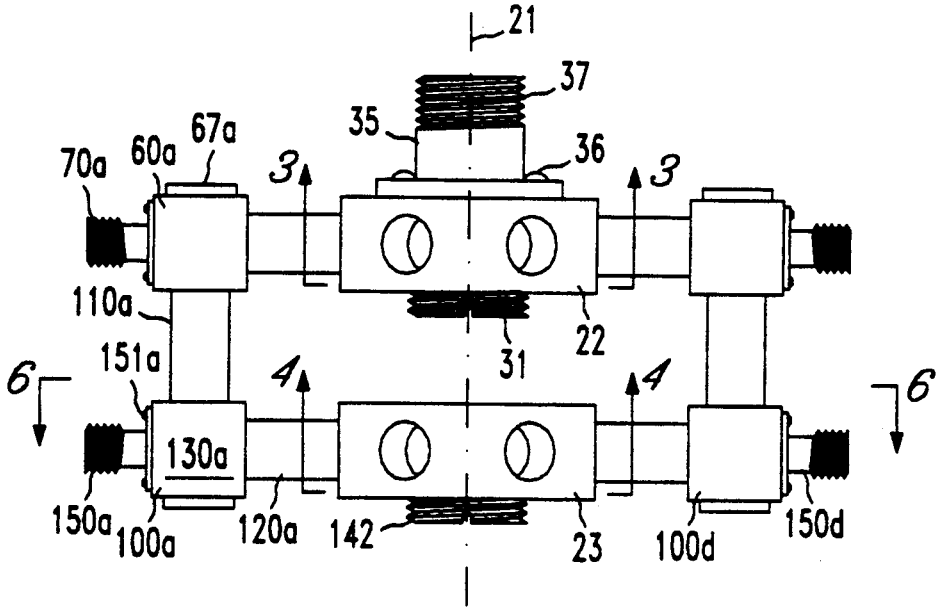
FIG. 2 is a front elevation of the FIG. 1 combiner with the front and rear extensions from the central hubs of the combiner being removed so as to show only those side extensions from such hubs which lie in a plane parallel to that of the drawing.

Upper hub 22 is in the form of a moderately thick circular cylindrical disc having its centerplane normal to axis 21, and having therein a large circular cylindrical bore 30 (FIG. 5) extending axially all the way through the hub. Bore 30 at its lower end has an internally threaded wall with which is engaged peripheral threading on a closure disc 31 adapted by turning it to be removed from the bore to provide access to its interior. In FIG. 2, disc 31 is shown as only partly screwed into bore 30.

At the upper end of bore 30 is a rigid primary coaxial signal transfer connector 35 of standard N type construction and mounted by screws 36 on the top of hub 22 to close off and be coaxial with bore 30. Connector 35 has a tubular outer conductor 37 externally threaded at its top, and the connector also has an inner filamental conductor 38 extending axially forward of conductor 37 to form a pin 39 projecting down into bore 30.

When assemblage 20 is in use, the primary connector 35 is adapted to be electromechanically coupled to means which is external to the assemblage and which, for example, may be a coaxial cable 40 (FIG. 5) having at its end near device 20 a fitting comprising a rotatable internally threaded cap 41 adapted to be threaded onto connector 35 to thereby couple the cable and connector together. Cable 40 may lead to, say, an antenna or other device (not shown) which, when assemblage 20 is a combiner, receives and utilizes the composite microwave signal which is the output of the combiner 20.

Figure 3:
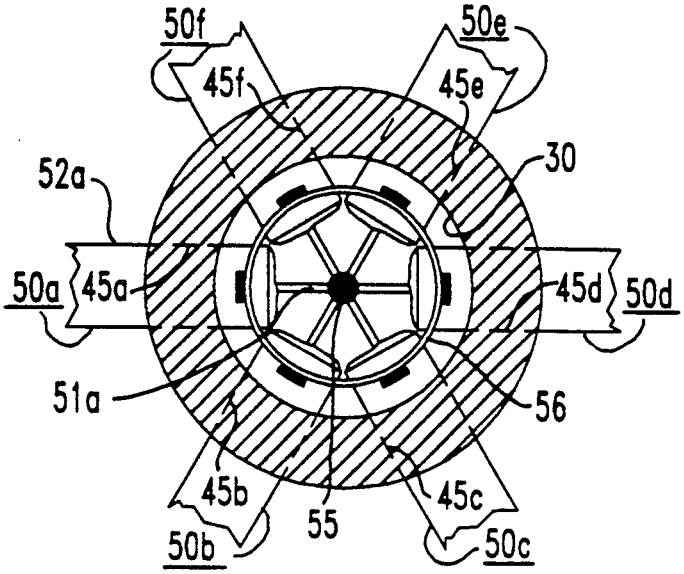
FIG. 3 is a fragmentary bottom view in cross-section, taken as indicated by the arrows 3—3 in FIG. 2, of the upper hub of the FIG. 1 combiner.

Equiangularly spaced around hub 22 are six small bores **45*a*–45*f* (FIG. 3) formed in the hub to be normal to axis 21 and extend radially from large bore 30 entirely through hub 22 to its outer periphery. Received with a tight fit in bores 45*a*–45*f* are inner portions of six respectively corresponding "first" coaxial line sections 50*a*–50*f* soldered to hub 22** at the point of entry of these sections into the hub.

These coaxial line sections have outer portions which are disposed outside hub 22, are of greater length than the inner hub portions, and project outward like spokes from the hub to form a star pattern. The first coaxial line sections 50 are all, mechanically speaking, rigid elements which are mechanically coupled together by hub 22 to all be in positionally fixed relation with each other and with the primary connector 35.

Considering the first coaxial line section **50*a*, it consists of a single continuous length of a coaxial line comprising (FIG. 5) a filamental inner conductor 51*a*, a tubular outer conductor 52*a* and dielectric material 53*a* disposed between conductors 51*a*, 52*a* and maintaining them in concentric relation. The outer conductor 52*a* is an electroconductive pipe which renders rigid the coaxial line 50*a*, and which serves both as the grounded outer electrical conductor for that line and as its external protective sheath which, when outside hub 22, is exposed to the exterior environment of assemblage 20**.

At the inner end of line **50*a*, its inner conductor 51*a* projects forward of its outer conductor 52*a* and into the center of bore 30 to make an electromechanical junction 55 at the end of that inner conductor with the bottom of the inner conductor pin 39 of the primary connector 35. The inner conductors of all of the other coaxial lines 50*b*–50*f* are similarly united at that junction 55 with such pin 39**.

The junction 55 is surrounded by a copper grounding ring 56 electromechanically connected by solder to the outer conductors of all the coaxial lines **50*a*–50*f* at the inner ends of these conductors projecting into the bore 30**.

Disposed at the outward ends of the coaxial lines **50*a*–50*f* are six respectively corresponding hollow cubic junction boxes 60*a*–60*f* (FIG. 1) of which the box 60*a* is exemplary. The box 60*a* comprises a cubic copper housing 61*a*, a cubic cavity 62*a* within that housing, registering circular passages 63*a*, 64*a* extending radially through housing 61*a* on radially opposite sides of cavity 62*a*, and registering circular passages 65*a*, 66*a* extending axially through housing 61*a*** on axially opposite sides of that cavity.

A radially outer portion of coaxial line **50*a* is received with a tight fit in the radially inner passage 63*a* in housing 61*a*, and the line and housing are soldered together. With the outer end of the line 50*a* being so received in that passage, the inner conductor 51*a* a projects forwardly to the center region of cavity 62***a*. In consequence of the tight fit and soldering just mentioned, the box 60*a* is united to and supported by the rigid line 50*a* to be held thereby in fixed position relative to all of lines 50*a*–50*f* and the primary connector 35. All of the other boxes 60*b*–60*f* are similarly positionally fixed by their corresponding rigid lines 50*b*–50*f* to all other of such lines and connector 35.

The six boxes 60*a*–60*f* carry six respectively corresponding secondary signal transfer coaxial connectors 70*a*–70*f* which are smaller in size than the primary connector 35, but which are of the same SMA type as is that connector. The connector 70*a* is exemplary of all of them. Connector 70*a* is mounted by screws 71*a* on the radially outer side of the housing 61*a* of the box 60*a* to cover the outer end of, and be concentric with, the radial passage 64*a* (FIG. 5) through that housing. Connector 71*a* has an outer conductor 72*a* which is externally threaded at its radially outer end, and the connector also has an inner filamental conductor 73*a* projecting into the central region of cavity 62*a* of box 60*a* to there be united at an electromechanical solder junction 74*a* with the inner conductor 51*a* of the coaxial line 50*a*. Apart from providing space for such junction, the box 60*a* serves as a mechanical coupling of the connector 70*a* to the line 50*a* in fixed positional relation therewith so that such connector 70*a* is positionally fixed relative to all of elements 22, 35, 50*a*–50*f* and 60*a*–60*f*.

The upper axial passage 65*a* through the housing 61*a* of box 60*a* is shown as being closed at its outer end by a thin sheet metal lid 67*a*. Prior to and during the making of junction 74*a* by soldering, lid 67*a* is not present on box 60*a*, and the passage 65*a* is open to provide access to the center of box cavity 62*a* to permit the making of that junction. After such junction has been formed, the lid 67*a* is soldered onto the top of box housing 61*a*.

When assemblage 20 is used as a combiner, the secondary connectors 70*a*–70*f* receive respective inputs from six microwave signal sources which may be, say microwave amplifiers of which the amplifiers 80*a* and 80*d* (FIG. 5) are exemplary. The output of amplifier 80*a* is connected to one end of a coaxial cable 81*a* terminating at its other end in a fitting comprising an internally threaded rotatable cap 82*a*. In the use of the combiner, the cap 82*a* is turned to engage its threading with the external threading on connector 70*a* so as to couple amplifier 80*a* through cable 81*a* to connector 70*a*. The other microwave amplifiers which respectively correspond to connectors 70*b*–70*f* are, in the use of combiner 20, similarly coupled to their corresponding connectors.

With connectors 70*a*–70*f* being coupled as described to receive inputs of microwave signals from external sources thereof, the coaxial lines 50*a*–50*f* serve as principal paths for transfer of such signals from such secondary connectors to the primary connector 35. As earlier discussed, however, a fraction of the microwave signal which is an input to any one of the secondary connectors will appear as an extraneous signal of significant level at all other of such secondary connectors in the absence of means to prevent that occurrence. Microwave assemblage 20 has such means which is as follows.

Assemblage 20 includes not only six "first" coaxial line sections 50*a*–50*f* but also six "second" coaxial line sections 100*a*–100*f* which respectively correspond to those first sections, and of which the second section 100*a* is exemplary. Section 100*a* is a composite structure having the shape of an "L" and comprising a radially outer vertical coaxial line 110*a* corresponding to the vertical arm of the "L", a radially extending horizontal coaxial line 120*a* corresponding to the horizontal arm of the "L" and a junction box 130*a* in the form of a hollow cube and disposed at the bend of the "L" where its arms intersect. The junction box 130*a* comprises a copper housing 131*a*, a cubic cavity 132*a* inclosed by that housing, registering radial passages 133*a* and 134*a* passing through inner and outer sides of housing 131*a* on radially opposite sides of cavity 132*a*, and registering axial passages 135*a*, 136*a* passing through upper and lower sides of housing 131*a* on axially opposite sides of the mentioned cavity. Upper axial passage 135*a* has received therein with a tight fit the lower end of vertical coaxial line 110*a* of which the upper end is received with a tight fit within the lower axial passage 66*a* formed in junction box 60*a*. Line 110*a* is also soldered to both of junction boxes 60*a* and 130*a*. Moreover, line 110*a* is a rigid coaxial line similar in construction to the line 50*a* earlier described. By virtue of line 110*a* being a rigid line and its tight fit within boxes 60*a* and 130*a* and its solder connection to both such boxes, the line 110*a* maintains box 130*a* in fixed positional relation to box 60*a* and, also, because of the fixed positional relations already described, to elements 50*a*–50*f*, 60*a*–60*f*, 70*a*–70*f*, hub 22 and primary connector 35.

Figure 5:
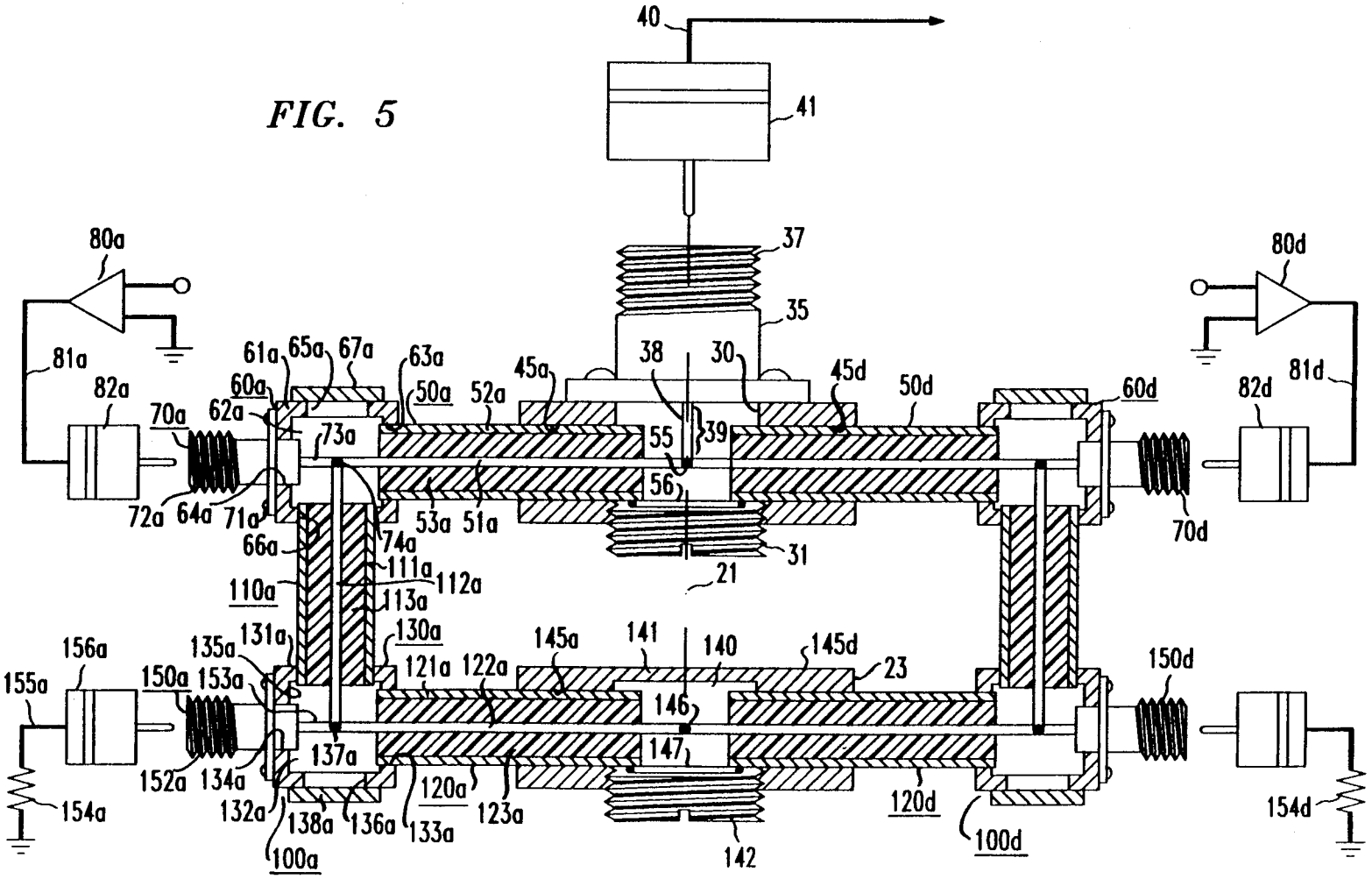
FIG. 5 is a front elevation in cross-section, taken as indicated by the arrows 5—5 in FIG. 1, of the FIG. 1 combiner.

As best shown in FIG. 5, the vertical coaxial line 110*a* comprises an outer conductor 111*a* in the form of a rigid electroconductive pipe, a filamental inner conductor 112*a* and dielectric material 113*a* disposed between conductors 111*a* and 112*a* and maintaining them in positionally fixed concentric relation. The upper end of inner conductor 112*a* projects into cavity 62*a* of box 60*a* to be united with the electromechanical junction 74*a* in that cavity of the inner conductors of, respectively, the secondary connector 70*a* and the "first" coaxial line 50*a*. The lower end of conductor 112 a projects into the central region of the cavity 132*a* of the junction box 130*a*.

The junction boxes 130 are at the level of the lower hub 23 of the assemblage 20. Hub 23 is disposed with its center plane normal to the assemblage axis 21, and the hub is similar in external shape to hub 22. Hub 22 has formed therein a large central cylindrical bore 140 (FIG. 5) having an opening at the bottom of the hub and extending upwards from that opening. Bore 140 does not, however, pass all the way vertically through the hub but, rather, is closed at its top by a web 141 so as to be a blind passage through the bore. The wall of bore 140 at its bottom has internal threading engaging with peripheral threading on a closure disc 142 adapted by its turning to selectively either be removed from the bore or to be inserted therein so as to form a closure for its bottom. In FIG. 2 and 5 the disc 142 is shown as partly removed from bore 140.

Equiangularly disposed around hub 23 are six small horizontal bores 145*a*–145*f* radially extending outward from bore 140 through hub 23 to its periphery. These six bores respectively correspond to the six coaxial lines 120*a*–120*f* providing the respective horizontal arms of the "L" shaped "second" coaxial line sections 100*a*–100*f*. Of the six coaxial horizontal lines, the already mentioned line 120*a* is exemplary.

The line 120*a* has its radially inner end and radially outer end received with a tight fit in, respectively, the radial passage 133*a* through the radially inner side of junction box housing 131*a*, and the radial passage 145*a* in the hub 23. Further, the line 120*a* is a rigid line soldered both to junction box 130*a* and hub 23. Because of the tight fit of line 120*a* in the two passages just mentioned and the rigidity of such line and its soldering to elements 23 and 130*a*, and, because, moreover, of the fixed positional relations already described as having been established, the coaxial line 120*a* helps support hub 23, and is itself supported, to be in positionally fixed relation to all the other elements included in assemblage 20.

As an electrical element, the coaxial line 120*a* is similar to the coaxial line 110*a* already described. That is, the line 120*a* comprises an outer conductor 121*a* in the form of a rigid electroconductive pipe, an inner filamental conductor 122*a* and dielectric material 123*a* disposed between conductors 121*a* and 122*a* to maintain them concentric. The radially outer end of conductor 122*a* extends into the central region of the cavity 132*a* of junction box 130*a* so that the tip of conductor 122*a* is united to the tip of inner conductor 112*a* at an electromechanical junction 137*a* of those two inner conductors. During forming of junction 137*a* by soldering, the lower axial passage 136*a* of box 130*a* is kept open to provide access to the interior of such junction but thereafter that passage is closed by a lid 138*a* soldered to box 130*a*.

The radially inner end of inner conductor 122*a* projects into the central region of the bore 140 in hub 23 to an electromechanical junction disposed in that region and designated as junction 146 and constituting an electromechanical junction of the radially inner ends of all of the inner conductors 120 of the second coaxial line sections 100*a*–100*f*.

Having described the parts of coaxial line section 100*a* and the way in which it is mechanically and electrically incorporated into assemblage 20, it will be appreciated that all of the other second coaxial line sections 100*b*–100*f* are similarly incorporated therein. That is, each of such other "L" shaped sections 100*b*–100*f* is, at its upper end (a) fixedly coupled mechanically to the corresponding one of junction boxes 60*b*–60*f*, and (b) electrically coupled by the inner conductor of its axially aligned coaxial line to the junction of the respective inner conductor of the corresponding one of first coaxial line sections 50*b*–50*f* and the corresponding one of secondary connectors 70*b*–70*f*, and, each of sections 100*b*–100*f* is, at its radially inner end, (c) fixedly mechanically coupled to hub 23, and (d) electrically coupled by the inner conductor of its radial coaxial line to junction 146 which, as stated, is the common junction of the radially inner ends of the inner conductors of all of the coaxial line sections 100*a*–100*f*.

Figure 4:
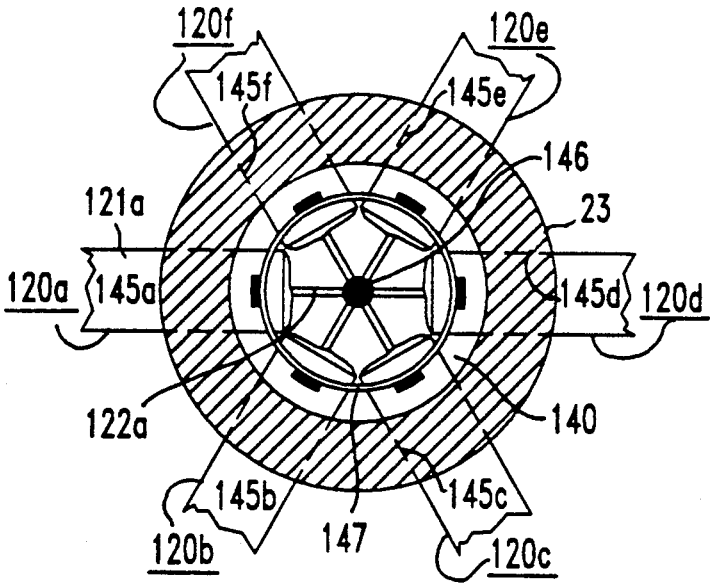
FIG. 4 is a fragmentary bottom view in cross-section, taken as indicated by the arrows 4—4 in FIG. 2, of the lower hub of the FIG. 1 combiner.

The junction 146 serves, electrically speaking, as a common floating point for such inner conductors. The junction is surrounded in bore 140 by a copper grounding ring 147 (FIG. 4) electromechanically connected by solder to the outer conductors of radial coaxial lines 120*a*–120*f* at the inner ends of those conductors projecting radially into the bore. Each of those lines 120 lies in the same axial-radial plane as does the corresponding one of the coaxial lines 50, and, as in the case of those upper radial lines 50 the lower radially extending lines 120 have outer portions projecting out in a star pattern from the periphery of hub 23.

Figure 6:
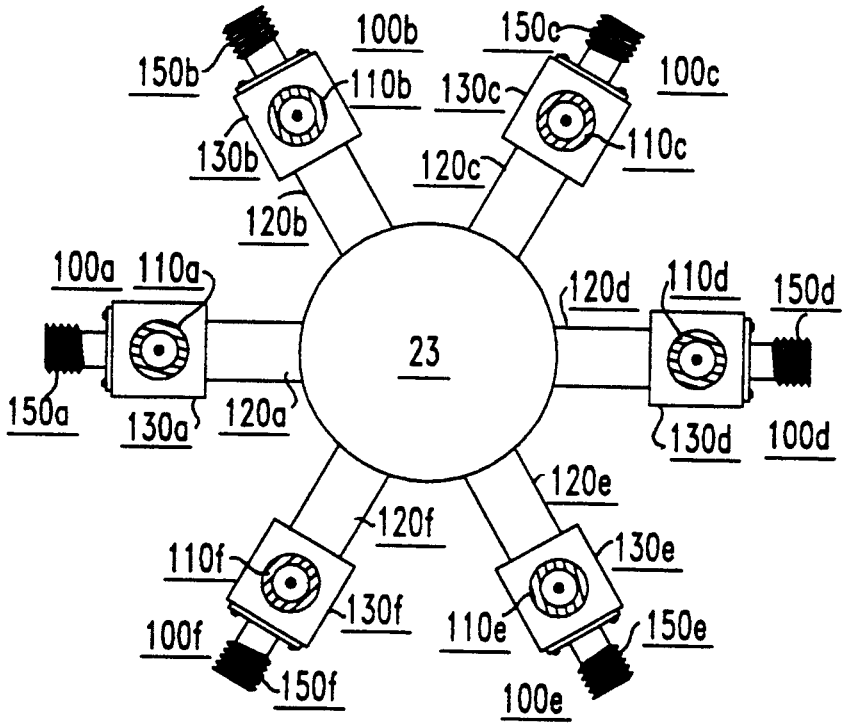
FIG. 6 is a plan view in cross-section, taken as indicated by the arrows 6—6 in FIG. 2 of the lower half of the FIG. 1 combiner.

The junction boxes 130*a*–130*f* at the bends of the L-shaped second coaxial line sections 100*a*–100*f* serve as supports for a set of respectively corresponding external load coaxial connectors 150*a*–15*f* (FIG. 6) of which the connectors 150*a* and 150*d* (FIGS. 2 and 5) are exemplary. The connector 150*a* is mounted by screws 151*a* on the radially outer side of junction box 130*a*, is a standard type coaxial connector, and comprises an outer conductor 152*a* which is externally threaded at its radially outer end, and, also, an inner conductor 153*a* extending onto the cavity 132*a* of junction box 130*a* to be united at junction 137*a* with the inner conductors of the coaxial lines 110*a* and 120*a*. FIG. 5 shows in association with connector 150*a* a grounded external load resistor 154*a* attached at its non-grounded end to a coaxial cable 155*a* terminating at its end away from the resistor in a fitting comprising an internally threaded rotatable cap 156*a*. In the use of the combiner 20, the cap 156*a* is threaded into the outer conductor 152*a* of connector 150*a* to electrically couple resistor 154*a* through cable 155*a* to coaxial section 100*a* at the junction of the two coaxial lines 110*a* and 120*a* included in that section.

From the mechanical viewpoint, the whole assemblage 20 is a rigid mechanical structure which is rugged and durable, and which completely confines within its interior the microwave signals transferred thereby. The assemblage is efficient in design in that it requires no boards or the like to provide support and that, with the exception of hubs 22 and 23, all of the elements of the assemblage have both a mechanical function and an electrical function. A significant factor in imparting rigidity to the structure as a whole of assemblage 20 is the rigid character of its various coaxial lines which serve as struts in coupling the hubs and the junction boxes to each other, and which are the only elements providing such couplings. That is, it is clear that if such coaxial lines were non-rigid, the hub 23, for example would not be maintained positionally fixed relative to hub 22.

Considering the electrical characteristics of assemblage 20, the outer conductors of all of its coaxial connectors and coaxial lines are electrically grounded. The midfrequency for the microwave signal transferred through primary connector 35 from or to the assemblage may conveniently be 1.847 GHz. All of the first coaxial line sections 50*a*–50*f* have the same electrical length, and all of the second coaxial line sections 100*a*–100*f* have the same electrical length.

The coaxial lines 50*a*–50*f* provide principal paths for transfer of signals between primary connector 35 and the secondary connectors 70*a*–70*f*, and the electrical impedance of each of these lines $=50\sqrt{N}=122$ ohms when $N=6$. The first fraction of a microwave signal at any one of such secondary connectors which is transmitted through ones of such principal paths to any other of such connectors as an extraneous signal is, as earlier described, opposed at such other connector by a second fraction of such signal traveling from such one to the other connector through one of supplemental paths provided by coaxial line sections 100*a*–100*f*, and appearing at such other connector as a second fraction of an extraneous signal in 180° phase relation to the mentioned first fraction. In assemblage 20, that 180° phase relation between the two opposing fractions of the extraneous signal can in theory be obtained when, whatever be the electrical length of each of the first coaxial line sections, the electrical length of each of the second coaxial line sections is one-quarter wave length greater for the microwave signal considered than the length of the first coaxial line sections. In practice, however, it is preferable and convenient in assemblages 20 for the coaxial lines 50*a*–50*f*, 110*a*–110*f*, and 120*a*–120*f* to all have an electrical length which is one quarter the wave length of such microwave signal, and for the second coaxial line sections 100*a*–100*f* to all have an electrical length which is one half the wavelength of such signal. It follows that all of those individual lines 50, 110, and 120 will have the same mechanical length, and that the second coaxial line sections 100 will have a mechanical length which is double that of the first coaxial line sections 50.

In order for the two fractions of the extraneous signal manifested at any of the secondary connections 70*a*–70*f* to best approach complete cancellation of each other, it is desirable that such fractions not only be opposite in phase but also be equal in amplitude. To the end of arriving in assemblage 20 to a good approximation of such equality of amplitude of those fractions, the coaxial lines 110*a*–110*f* and 120*a*–120*f* each have a characteristic impedance of 50 ohms, the coaxial lines 50*a*–50*f* each have a characteristic impedance of 122 ohms, the primary connector 35 has a characteristic impedance of 50 ohms, the secondary coaxial connectors 70*a*–70*f* have a characteristic impedance of 50 ohms, and the external load resistors 154 have a resistance of 50 ohms.

While assemblage 20 has been described in terms of its use as a combiner, it is equally capable of being used as a microwave signal splitter by making minor changes in the relationship of assemblage 20 to the external instrumentalities with which it is connected. The changes necessary to convert assemblage 20 into a splitter are that the external means 40 connected to primary connector 35 becomes a source of microwave signals supplied as an input to such connector, and that the connector 70 supply microwave signals to the inputs of amplifiers 80.

When N is the number of secondary coaxial connectors, the number N for the particular splitter/combiner described above is six since six such connectors 70*a*–70*f* have been disclosed. However, assemblage 20 can be constructed so that the N is the number 2 at a minimum or any integral number which is greater than 2 but small enough to permit incorporation of secondary connectors of that number within the structure of the assemblage.

The above described embodiment being exemplary only, it is to be understood that additions thereto, omissions therefrom and modifications thereof can be made without departing from the spirit of the invention.

For example, a preferred modified construction of hubs 22 and 23 is as follows. Each hub is split along its equatorial centerplane to convert the hub into two halves and to convert the small radial bores of the hub into registering pairs of grooves which are almost hemicylindrical but not quite in that their cylindrical surfaces angularly extend by a small amount less than 180° about the axes of such grooves. With the two halves of the hub being separated, there is inserted into the grooves in the lower half the coaxial lines to be seated therein (such lines having the same outer radius as the radius of such grooves), the upper hub half is then coaxially placed over the lower hub half so that the grooves in the upper half fit over the lines already seated in the grooves in the lower half, and the two halves are then clamped together by conventional mechanical means to grip the coaxial lines firmly and fixedly within the hub.

Accordingly, the invention is not be considered as limited save as is consonant with the recitals of the following claims.

I claim:

1. A microwave assemblage comprising a primary coaxial signal-transfer connector, a plurality of first rigid equal-length coaxial line sections extending from inner ends thereof adjacent to and electrically coupled to said connector to outer ends of such sections, means mechanically coupling said first sections at their inner ends in positionally fixed relation with each other and said connector, a plurality of secondary coaxial signal-transfer connectors respectively corresponding to said first sections and disposed at their outer ends in electrically coupled relation therewith, said secondary connectors being mechanically coupled with said rigid first sections to be positionally fixed relative to each other and said first sections, a plurality of second equal-length coaxial line sections respectively corresponding to said first sections and having respective outer and inner ends of which the outer ends are mechanically and electrically coupled with said first sections at their outer ends, and of which the inner ends of said second sections are adjacent to each other and electrically and mechanically coupled together, said second sections being of different lengths than said first sections, and a plurality of external load coaxial connectors respectively corresponding to said second sections and each electrically and mechanically coupled to its corresponding second section centrally in its length between the inner and outer ends thereof.

2. A microwave assemblage according to claim 1 in which said second line sections are rigid and are fixedly mechanically coupled at their outer ends with said first sections at their outer ends.

3. A microwave assemblage according to claim 2 further comprising means mechanically coupling said rigid second sections at their inner ends in positionally fixed relation with each other.

4. A microwave assemblage according to claim 3 in which said second sections are all in the shape of an "L" and the external load connector corresponding to each such section is coupled thereto at the bend of the "L" shape thereof.

5. A microwave assemblage according to claim 4 in which the two arms of the "L" shape of each such second section are provided respectively by two rigid coaxial lines of equal length and the same characteristic impedance.

6. A microwave assemblage according to claim 1 in which the length of each of said second coaxial line sections is double the length of said first coaxial line sections.

7. A microwave assemblage according to claim 1 in which all of said connectors and coaxial line sections comprise respective inner conductors, the inner conductors of said first sections are all coupled at the inner ends of such sections to the inner conductor of said primary connector and are respectively coupled at the outer ends of such sections to the inner conductors of the secondary signal transfer connectors at such outer ends, and the inner conductors of said second sections are respectively coupled at the outer ends of such sections to the inner conductors of the corresponding first sections, and, moreover, are all coupled at the inner ends of such second sections to a common floating point.

8. A microwave assemblage according to claim 1 in which said device is adapted for use as a signal splitter.

9. A microwave assemblage according to claim 1 in which said device is adapted for use as a signal combiner.

10. A microwave assemblage comprising a primary coaxial signal transfer connector having an axis and an axially rearward portion couplable to external means for transfer of signals between such device and means, a plurality of first rigid equal-length coaxial line sections having inner ends adjacent to and electrically coupled with said connector, said first sections extending in a star pattern radially from said inner ends to outer ends of said sections, first means mechanically coupling said first sections at their inner ends in positionally fixed relation with each other and said connector, a plurality of secondary coaxial signal transfer connectors respectively corresponding to said first sections and disposed at their outer ends in electrically coupled relation therewith, said secondary connectors being mechanically coupled with said rigid first sections to be positionally fixed relative to each other and said first sections, a plurality of second rigid equal-length coaxial line sections respectively corresponding to said first sections and having respective outer and inner ends of which the outer ends are mechanically and electrically coupled with said first sections at their outer ends, and of which the inner ends of said second sections are adjacent to each other and said axis, and are electrically coupled to a common floating point, said second sections extending from their outer ends axially forward from said first sections to bends in such second sections and, from such bends, radially inwards to the inner ends of such second sections so as to render such second sections of "L" shape, and to form by such radial extents of such second sections a star pattern, second means spaced axially forward of said first means and mechanically coupling said second sections at their inner ends in positionally fixed relation with each other, and a plurality of external load coaxial connectors respectively corresponding to said second coaxial line sections and disposed at said bends of said second sections in electrically coupled relation therewith, said external load connectors being mechanically coupled with said second sections to be positionally fixed relative to each other and said second sections.

11. A microwave assemblage according to claim 10 in which each of said second coaxial line sections lies in an axial-radial plane containing the corresponding first coaxial line section.

12. A microwave assemblage comprising a primary coaxial signal-transfer connector, a plurality of first rigid coaxial line sections each comprising a tubular outer conductor respective thereto and an inner conductor radially spaced from and within said outer conductor,said sections extending from inner ends thereof adjacent to and electrically coupled to said connector to outer ends of such sections, means mechanically coupling said first sections at their inner ends in positionally fixed relation with each other and said connector, a plurality of secondary coaxial signal-transfer connectors respectively corresponding to said first sections and disposed at their outer ends in electrically coupled relation therewith, said secondary connectors being mechanically coupled with said rigid first sections to be positionally fixed relative to each other and said first sections, and a plurality of second coaxial line sections each comprising a tubular outer conductor respective thereto and an inner conductor radially spaced from and within such outer conductor, said second sections respectively corresponding to said first sections and having respective outer and inner ends of which the outer ends are mechanically and electrically coupled with said first sections at their outer ends, and of which the inner ends of said second sections are adjacent to each other and electrically and mechanically coupled together, each of said second sections being of a different mechanical length then that of the corresponding first section.

* * * * *